US005174142A

United States Patent [19]

Pong

[11] Patent Number: 5,174,142

[45] Date of Patent: Dec. 29, 1992

[54] METHOD AND APPARATUS FOR GUIDING A ROD TO A SLITTER STATION

[76] Inventor: David T. Pong, Shiu Wing Steel Ltd., 1209 Jardine House, 1 Connaught Place, Hong Kong

[21] Appl. No.: 746,425

[22] Filed: Aug. 16, 1991

[51] Int. Cl.[5] ..... B21B 1/18; B21B 15/00; B21B 39/16

[52] U.S. Cl. ..... 72/12; 72/37; 72/204; 72/250; 72/428; 83/445

[58] Field of Search ..... 72/12, 16, 37, 203, 72/204, 250, 428, 17, 21, 222, 221; 83/407, 412, 420, 421, 445; 226/179, 192

[56] References Cited

U.S. PATENT DOCUMENTS

| | | | |
|---|---|---|---|
| 2,325,373 | 7/1943 | Corsini | 72/222 |
| 3,526,113 | 9/1970 | McNaugher | 72/16 |
| 3,935,722 | 2/1976 | Bock | 72/250 |
| 4,039,107 | 8/1977 | Boley | 72/250 |
| 4,357,819 | 11/1982 | Elley | 72/204 |
| 4,779,439 | 10/1988 | Baldi | 72/204 |

FOREIGN PATENT DOCUMENTS

| | | | |
|---|---|---|---|
| 3602522 | 7/1987 | Fed. Rep. of Germany | 72/204 |
| 0038071 | 12/1975 | Japan | 72/37 |
| 0009709 | 1/1983 | Japan | 72/12 |

OTHER PUBLICATIONS

Iron and Steel Engineer, May 1984, pp. 54–60, "Analysis of Rolled Bar Profile from Scanning Laser Gage Diameter Readings", by Harbeck.

*Primary Examiner*—Lowell A. Larson
*Assistant Examiner*—Thomas C. Schoeffler
*Attorney, Agent, or Firm*—Ladas & Parry

[57] ABSTRACT

A method and apparatus for accurately slitting a rod into two equal sections in which the rod is longitudinally advanced to a slitter and is laterally shifted by an in-line guide adjustment system or 1GA so that the slit sections will be equal. The rod sections are measured by the 1GA after slitting to evaluate any difference in size therebetween while the sections are advancing, and the 1GA transversely shifts the rod before it enters the slitter to eliminate any size differential between the slit sections.

16 Claims, 3 Drawing Sheets

METHOD AND APPARATUS FOR GUIDING A ROD TO A SLITTER STATION

FIELD OF THE INVENTION

The invention relates to methods and apparatus for the guiding of a longitudinally advancing rod or bar to a slitter station in which the rod is slit into two sections and more particularly to methods and apparatus for transversely controlling the position of entry of the rod into the slitter station so that the slit sections will be equal in size.

The invention is particularly applicable to a guide means positioned upstream of the slitter station for laterally shifting the longitudinally advancing rod in response to any size differential of the slit sections leaving the slitter station in order to equalize said sections.

BACKGROUND AND PRIOR ART

In my prior applications 07/474,285 filed Feb. 2, 1990 (now abandoned) and 07/549,351 filed Jul. 6, 1990 (now U.S. Pat. No. 5,027,632), there is disclosed the production of small size steel reinforcing bars by a slit rolling method in which a substantial increase in speed is obtained by eliminating twisting of the advancing rod prior to its introduction to the slitter station. Such a method is referred to as the no twist slit-rolling approach method or NTA method.

In the production of small size steel reinforcing bars using the slit rolling method, a substantial increase in rolling speeds can be achieved by the NTA method, as previously noted, and in order to reduce unnecessary down time, there now exists a substantial need to successfully and reliably achieve the increased rolling speed of the NTA method.

In slit rolling, the advancing bar supplied to the slitter station has a "clover" cross section. In the slitter station, the "clover" section of the bar is rolled in a rolling stand to a "peanut" section and the bar of "peanut" section is supplied to a slitter stand where the bar is longitudinally divided into two identical sections.

In a single strand rolling operation (without slitting), in order to eliminate tension in the bar, loops are purposely formed in the steel bar between successive stands. An optical sensor is used to detect the size of the loop and an output signal of the sensor is used to regulate the speeds of the mill motors in the successive stands (generally the downstream strand) to maintain a stable loop.

In slit rolling, two parallel sections emerge from the same stand after slitting. When the two loops of the slit sections are not the same, two different signals, would be produced and the control equipment would not be able to function.

While off line visual checks of alignment can give a good approximation, a small deviation of the alignment of guide means for the bar during rolling will give rise to unequal slitting. This will result in two problems.

1) The two finished bars will be different in weight. This produces a less desirable product as market requirements are for a ½ DIN tolerance.

2) In extreme cases, the loop growth of one of the slit sections may become uncontrollable.

In both cases, stoppage of production is inevitable.

At present, the highest rolling speed claimed for delivery of a single strand onto a cooling bed is about 20 M/s. This corresponds to a slitting operation at about 6.4 M/s. For slit rolling of 10 mm bars, the section being slit is a "clover" with a side dimension of 25 mm. A lateral deviation of 0.1 mm of alignment of the entry guide to the slitter station would produce an imbalance of 1.6% in the two slit sections or strands of the bar. At 6.4 M/s rolling speeds, this would mean the loop of the larger slit section will increase 102 mm per second more than the smaller slit section. For a typical 1,000 kg billet, the rolling time through the finishing stand, after slitting is 48.1 seconds. This means that before the strands are through the last finishing stands, the difference in length of the two loops would be about 4.3 meters. Because of such difference in length, the parallel loops cannot be compensated by varying the speeds of the mill motors, without causing undesirable tension on the smaller slit section.

The above evaluation is only to illustrate the sensitivity of the effect of imbalanced strands. In practice, the imbalance would be substantially higher than the example given. A system of NKK of Japan is known for adjusting a guide by manual means from a control pulpit. While this may be acceptable in low speed slit rolling, human response would not be fast enough for high speed rolling.

SUMMARY OF THE INVENTION

An object of the invention is to provide a method and apparatus which overcomes the inherent problem of balancing the two slit sections, without interrupting production and wherein the two loops of the slit sections can be held stable by conventional loop control rollers.

A further object of the invention is to provide a method and apparatus by which the rod or bar advancing to the slitter station is transversely shifted automatically and without human intervention to compensate for any size difference between the slit sections.

A further object of the invention is to provide a method and apparatus by which the rod or bar advancing to the slitter station is transversely shifted to eliminate any size difference between the slit sections, said size difference being determined by measuring the two slit sections after they are discharged from the slitter station, specifically by measuring the size of the loops formed by the slit sections after they leave the slitter station.

The invention contemplates an in-line guide adjustment system, referred to as 1GA, for automatically shifting the advancing bar or rod laterally to produce slit sections of equal cross-section.

A feature of the invention is that the rod is shifted automatically without human intervention substantially instantaneously to maintain equal sizes of the slit sections so that the high speeds of the NTA method can be realized without interruption or slowdown.

According to the invention, the in-line guide adjustment system comprises a laterally adjustable guide means positioned upstream of the slitter station for guiding the longitudinally advancing bar or rod to said slitter station, means for comparing the two slit sections exiting from the slitter station to produce an output signal indicative of any difference between said sections, and means for receiving the output signal from the comparing means for laterally adjusting said guide means so that the bar enters the slitter station in a position in which the slit sections from the slitter station are equalized.

In a particular embodiment, the comparing means comprises sensor means operating on respective slit sections for producing signals representative of the size of said sections and comparator means connected to said sensor means for producing said output signal to control the guide means when there is difference in the signals from said sensor means. The sensor means can be constructed to measure the size of the loops formed by each of the slit sections after they exit from the slitter station. In a preferred embodiment the sensor means comprises a non-contact optical sensor.

In further accordance with the invention, the guide means for guiding the bar to the slitter station comprises a guide member including means for guiding the longitudinally advancing bar to the slitter station, means supporting said guide member for transverse movement to laterally adjust the position of entry of the bar into the slitter station, drive means for driving the guide member in movement transversely of the longitudinally advancing bar, and means for operating said drive means so that the guide member will be transversely moved to a position at which the slit sections exiting from the slitter station will be of equal size.

In a particular embodiment, the means which supports the guide member comprises a rigid base having a guide surface on which said guide member is slidably mounted, said drive means comprising a drive screw connected to said guide member to slide the guide member on the base as said drive screw undergoes rotation and a drive motor drivingly connected to said drive screw.

Said base can be in the form of an open channel including spaced legs having upper surfaces constituting said guide surface, said guide member riding on said guide surface, said drive screw extending in said open channel between said legs thereof.

On the guide member is a means for engaging the drive screw so that upon rotation of the drive screw the guide member slides on said guide surface.

The means for guiding the bar to the slitter station comprises a pair of spaced guide rollers fixed to the guide member for rotation around respective axes perpendicular to said guide surface.

DETAILED DESCRIPTION OF A PREFERRED EMBODIMENT OF THE INVENTION

Figure 1:
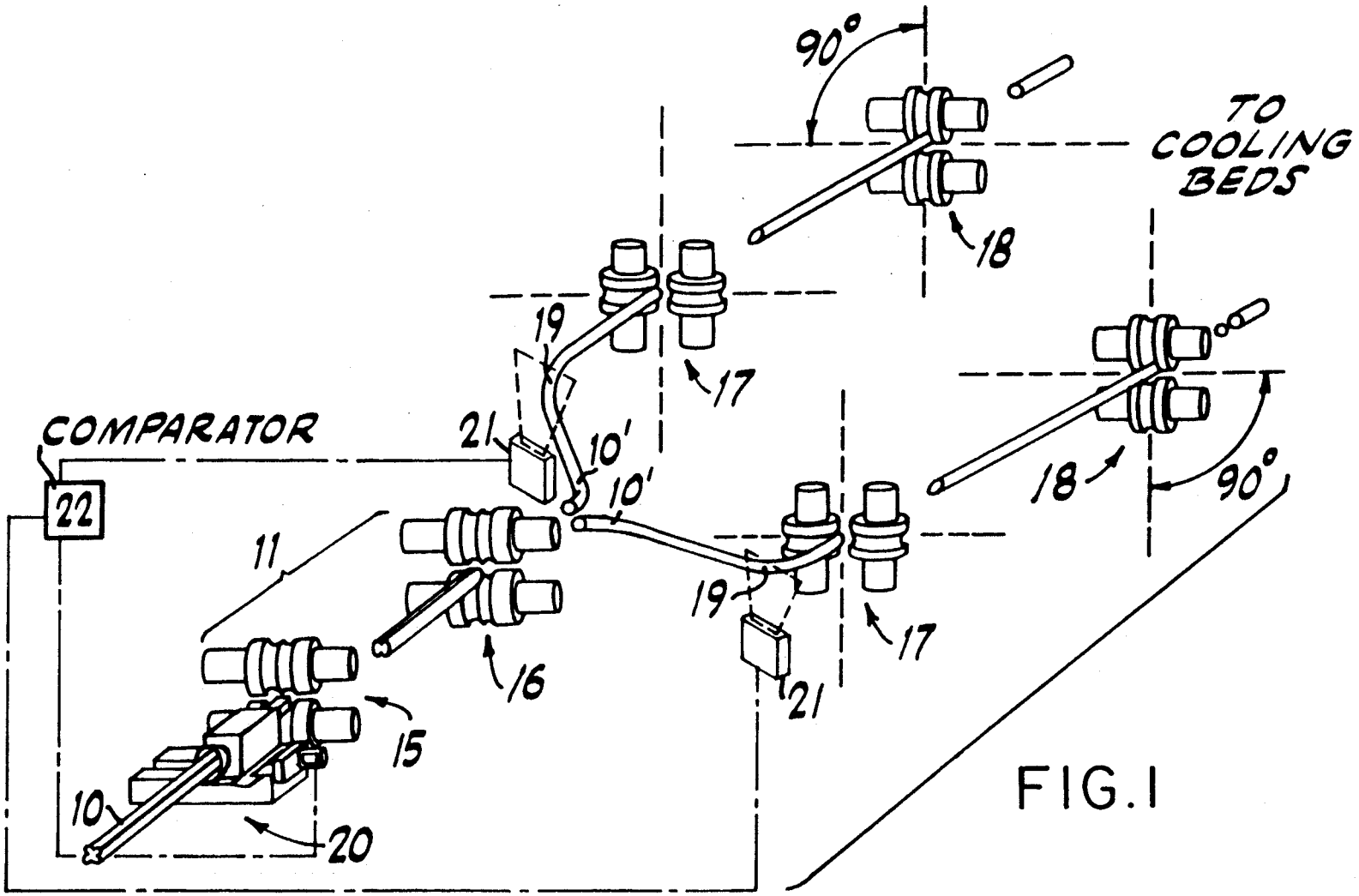
FIG. 1 is a diagrammatic illustration of a method and apparatus for carrying out no-twist slit rolling according to the invention.
Figure 2:
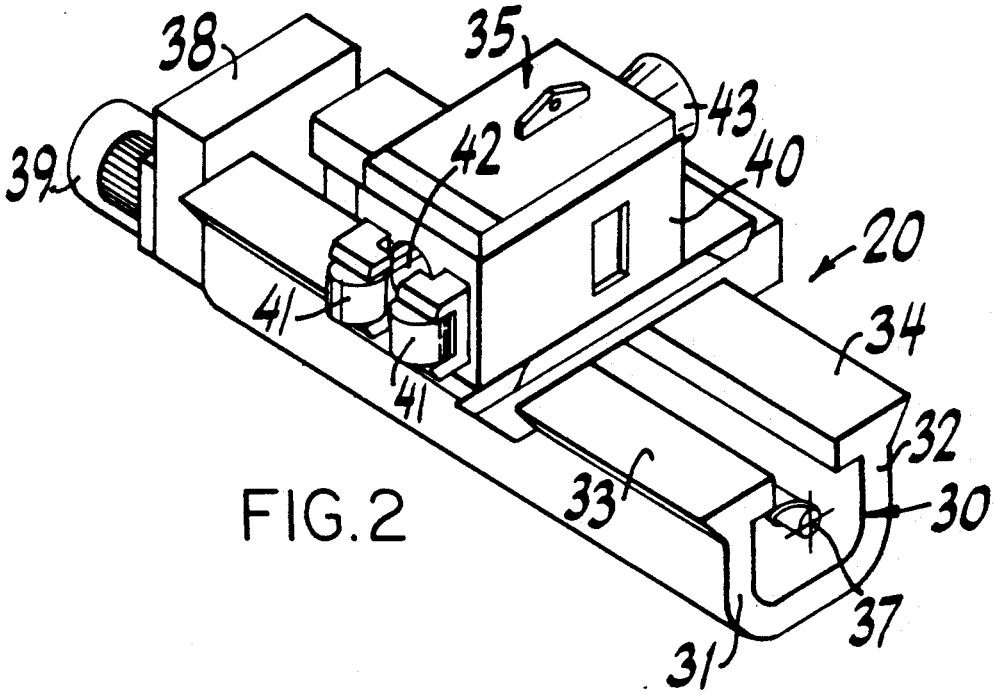
FIG. 2 is a perspective view of a guide mechanism of the apparatus of the invention.
Figure 3:
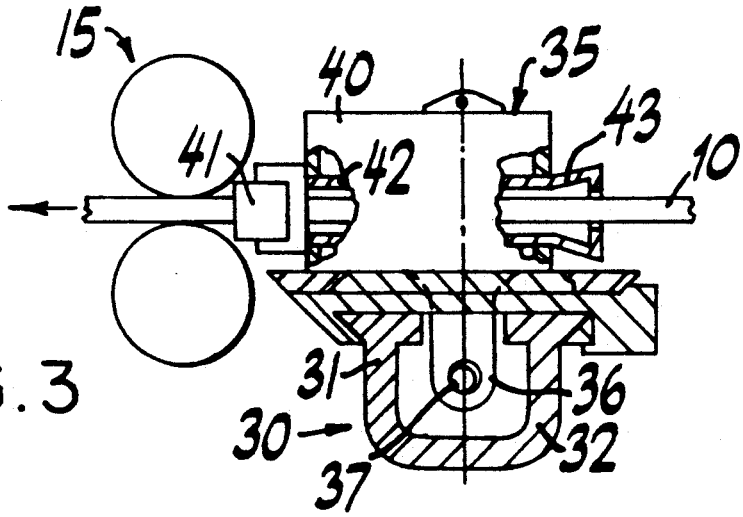
FIG. 3 is a transverse view of the guide mechanism at the entry to a slitting station, the guide mechanism being shown partly in section and partly broken away.
Figure 4:
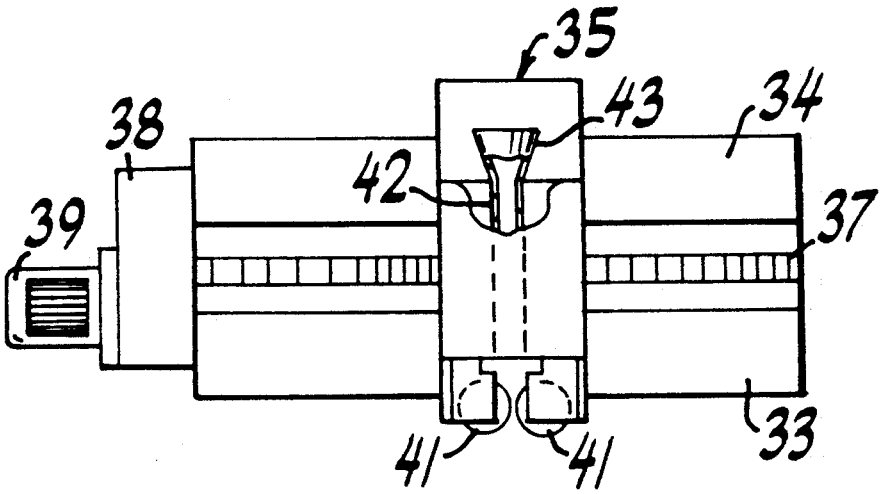
FIG. 4 is a plan view of the guide mechanism in FIG. 2.
Figure 5:
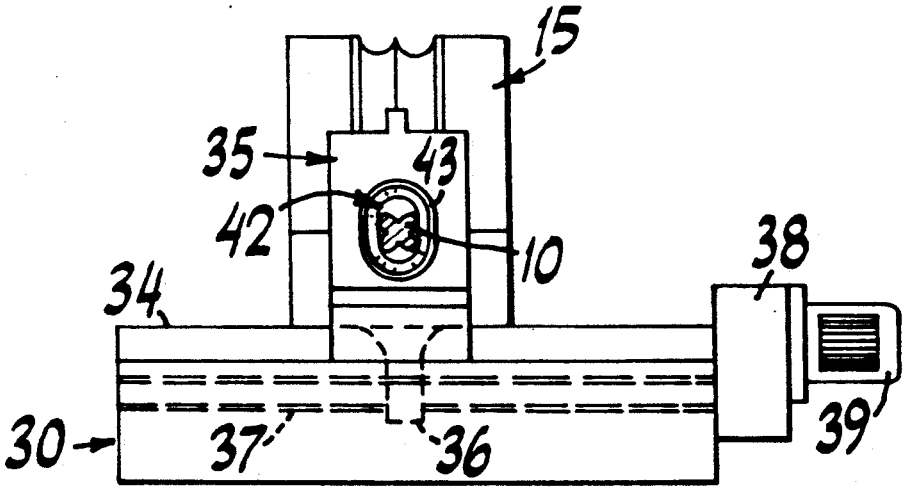
FIG. 5 is a side elevational view of the guide mechanism viewed in a direction downstream of the longitudinally advancing bar.

FIG. 1 shows a portion of the apparatus for carrying out a no twist slit-rolling approach method on a longitudinally advancing bar or rod 10. The rod 10 is rolled in upstream roll stands (not shown) to obtain a "clover" cross section and the rod is supplied without previous twisting, to a slitter station 11 where the rod is shaped and slit to form separate sections 10'. The slitter station comprises a roll stand 15 at which the "clover" section of the rod is changed to a "peanut" section and a slitter stand 16 at which the rod of "peanut" section is slit to form sections 10' which are fed through finishing stands 17 and 18 in respective finishing lines whereafter the finished sections are fed as rectilinear reinforcing rods to cooling beds. The method is referred to as the NTA method and its details can be found in my earlier U.S. Patent Applications which are referred to in the background and prior art section hereinabove.

The rod 10 of "clover" cross section is supplied to a guide mechanism 20 positioned in front of roll stand 15 in slitter station 11. The stands 15, 16 17 and 18 each includes support frames and opposed rollers which are motor driven but the frames and motors are not illustrated in order not to obscure the details of the present invention.

In the slitter stand 16, the bar 10 of "peanut" section is slit longitudinally, substantially along the median longitudinal axis of the bar, and the resulting slit sections 10' are each formed with loops 19 in travelling from slitter stand 16 to the first finishing stands 17 in the respective finishing lines. The loops 19 are formed on looping tables (not shown) as is entirely conventional. In general, the loops 19 are formed by adjusting the speeds of the rollers of stands 16 and 17.

If the bar 10 is not slit to produce sections 10' of identical size, the loops 19 formed by the sections 10' will be of different size. The size difference of the loops is very sensitive to the difference in size of the cross-sections of the slit sections 10'.

A sensor means 21 is disposed at each loop 19 of a respective section 10' to measure the size of the loop. The sensor means 21 is preferably in the form of a non-contact optical sensor of conventional design which measures the size of the loop and produces an output signal representative thereof. The sensor 21 can be a conventional IR sensor made by ASEA of Sweden or Siemens of Germany. The sensors 21 are shown below each slit section 10' but preferably they are located above the loops 19 to prevent foreign matter from dropping on the sensors. The sensors 21 are connected to a comparator 22 in which the output signals of the sensors 21 are compared to determine any deviation in equality of the output signals. Upon detection of a deviation in size of the two loops 19, and thereby of the slit sections 10', beyond a threshold value, the comparator 22 produces an output signal which is supplied to the guide mechanism 20. The guide mechanism 20 serves to shift the position of entry of the bar 10 into the slitter station 11 laterally in order to equalize the size of the loops 19 and thereby the size of the slit sections 10'.

The guide mechanism 20 comprises a rigid base 30 of open channel shape having spaced upstanding legs 31 and 32 with upper guide surfaces 33 and 34 respectively. The base 30 is similar to a bed plate of a conventional horizontal lathe which has proven to be very rigid during metal cutting operations on the lathe. A guide member 35 slidably rides on the guide surfaces 33 and 34 for movement transversely of the longitudinally advancing bar 10. The guide member 35 includes a downwardly depending tang 36 which threadably engages a drive screw 37 extending within the open channel base 30 between the legs 31 and 32 thereof. The drive screw 37 is connected through a drive transmission 38 to a drive motor 39. When the drive motor 39 drives the drive screw 37 in rotation, the guide member 35 is transversely shifted on the support surfaces 33 and 34. The drive motor 39 is connected to the comparator 22 so that the drive motor 39 will be activated when the comparator produces an output signal indicating difference in size of the loops 19 of the slit sections 10' resulting from difference in size of the slit sections.

The guide member 35 includes an upstanding casing 40 carrying guide rollers 41 at the front of the guide member facing the rollers of the roll stand 15 so that the bar 10 coming from the guide rollers 41 will be guidably fed to the stand 15 of the slitter station 11. The guide rollers 41 are supported by the casing 40 for rotation about axes extending perpendicularly to the axis of bar 10 and to the guide surfaces 33, 34. A tubular insert member 42 with a funnel-shaped end 43 is mounted in casing 40 so that the bar 10 enters the funnel shaped end 43 and travels with clearance in insert member 42 to the rollers 41. The lateral position of guide member 35 determines the position of rollers 41 and thereby the point of entry of the bar 10 to stand 15. The rollers 41 are positioned close to the rollers of stand 15 to assure accurate entry of the bar 10 to the rollers of stand 15. In normal operation, the rollers 41 will be approximately 100 mm from stand 15.

In operation, when the sensors 21 produce signals representing inequality of the size of the loops 19 of the slit sections 10', an output signal is produced by the comparator 22 to drive the motor 39 and shift the guide member 35 in a direction so that the bar 10 will be supplied to the slitter station 11 to produce slit sections 10' of identical size. The guide mechanism 20, the sensors 21 and comparator 22 constitute an in-line guide adjustment system or IGA whose operation takes place during production and there is no need to close down the system to balance the two slit sections as in the conventional art.

With the method and construction of the invention it is possible to realize the increased speeds obtained by the NTA method without any stoppage of production.

Although the invention has been described in relation to a specific embodiment thereof it will become apparent to those skilled in the art that numerous modifications and variations can be made within the spirit and scope of the invention as defined in the attached claims.

What is claimed is:

1. Apparatus for accurately slitting a rod into two equal sections, comprising:

slitter means for slitting a longitudinally advancing rod into two section, said two sections being advanced to respective finishing stands, means downstream of the slitter means for comparing the two slit sections to one another to produce an output signal indicative of a difference between said sections, laterally adjustable guide means positioned upstream of said slitter means for guiding the longitudinally advancing rod to said slitter means, and means receiving the output signal from the comparing means for laterally adjusting said guide means so that the rod enters the slitter means in a position in which the slit sections from the slitter means are equalized.

2. Apparatus as claimed in claim 1 wherein said comparing means comprises sensor means operating on respective slit sections for producing signals representing size of said sections and comparator means connected to said sensor means for comparing said signals representing the size of the respective slit sections for producing said output signal when there is difference in the signals from said sensor means.

3. Apparatus as claimed in claim 2 wherein said slit sections form respective loops when said sections leave the slitter means, said sensor means measuring size of said loops.

4. Apparatus as claimed in claim 3 wherein said guide means comprises a laterally displaceable guide member, drive means for driving said guide member laterally, and means for operating said drive means in response to said output signal from said comparator means.

5. Apparatus as claimed in claim 4 wherein said slitter means comprises a roll stand positioned downstream of and adjacent to said guide member for receiving the advancing rod therefrom, and a slitter stand downstream of said roll stand for receiving the advancing rod from said roll stand and slitting said rod into said two slit sections.

6. Apparatus as claimed in claim 5 wherein each said sensor means comprises a non-contact optical sensor.

7. Apparatus as claimed in claim 1 further comprising means for longitudinally advancing said rod to said slitter means at a relatively high speed without prior twisting of the rod.

8. A guide mechanism for guiding a reinforcing rod to a slitter means, comprising:

a guide member including means for guiding a longitudinally advancing reinforcing rod to a slitter means in which the rod is slit into two sections;

means supporting said guide member for transverse movement to laterally adjust the entry of the rod into the slitter means, drive means for driving the guide member in transverse movement, and means for operating said drive means so that the guide member will be transversely moved to a position at which slit sections of equal size will be produced by the slitter means, said means supporting said guide member comprising a rigid base having a guide surface on which said guide member is slidably mounted, said drive means comprising a rotatable drive screw connected to said guide member to slide the guide member on the base as said drive screw undergoes rotation, and a drive motor drivingly connected to said drive screw, said base comprising an open channel including spaced legs have surfaces constituting said guide surface, said drive screw extending in said open channel between said spaced legs, a downwardly depending tang being fixed to said guide member and engaging said drive screw so that upon rotation of said drive screw said guide member slides on said guide surface.

9. A guide mechanism as claimed in claim 8 wherein said means for guiding the rod to the slitter means comprises a pair of spaced rotatable guide rollers fixed to said guide member.

10. A guide mechanism as claimed in claim 9 wherein said guide rollers are supported on said guide member for rotation around respective axes extending perpendicular to said guide surface.

11. A guide mechanism as claimed in claim 10 wherein said guide rollers face downstream towards said slitter means.

12. A guide mechanism as claimed in claim 11 comprising a funnel-shaped member on said guide member facing upstream for receiving the advancing rod and guiding the rod to said roller.

13. A method of accurately slitting a rod into two equal sections, comprising:

longitudinally advancing a rod to a slitter means at a relatively high speed without prior twisting in a no-twist slit rolling approach operation, slitting the rod in the slitter means into two rod sections, feeding each of the rod sections from the slitter means to a respective finishing stand, measuring the rod sections as they travel from the slitter means to the finishing stands to determine any difference in size between said rod sections, and transversely shifting the rod advancing to the slitter means to compensate for and eliminate any size difference between the slit sections.

14. A method as claimed in claim 13, said measuring of the rod sections being effected by measuring the size of loops formed in the rod sections between the slitter means and the finishing stands and comparing the size of said loops.

15. A method as claimed in claim 14 comprising laterally guiding the rod for its entry into the slitter means.

16. A method as claimed in claim 15 wherein the transverse shifting of the rod is effected in response to producing a signal representing a difference in the size of the loops.

* * * * *